US008613213B2

(12) United States Patent
Thaddaeus

(10) Patent No.: US 8,613,213 B2
(45) Date of Patent: Dec. 24, 2013

(54) INTERCHANGEABLE SPRING LOADED SCRAP CUTTER

(75) Inventor: Sunil J. S. Thaddaeus, Greenville, SC (US)

(73) Assignee: Magna International Inc., Aurora, Ontario (CA)

( * ) Notice: Subject to any disclaimer, the term of this patent is extended or adjusted under 35 U.S.C. 154(b) by 498 days.

(21) Appl. No.: 12/703,886

(22) Filed: Feb. 11, 2010

(65) Prior Publication Data

US 2010/0199739 A1 Aug. 12, 2010

Related U.S. Application Data

(60) Provisional application No. 61/152,062, filed on Feb. 12, 2009.

(51) Int. Cl.

| | |
|---|---|
| ***B21D 22/00*** | (2006.01) |
| ***B21D 22/21*** | (2006.01) |
| *B21D 31/02* | (2006.01) |
| *B21D 28/00* | (2006.01) |

(52) U.S. Cl.
USPC ..... 72/348; 72/326; 72/332

(58) Field of Classification Search
USPC ..... 72/325, 326, 327, 328, 332, 333, 334, 72/338, 465.1, 466.9, 481.1, 482.91, 72/482.92, 347–348
See application file for complete search history.

(56) References Cited

U.S. PATENT DOCUMENTS

| | | | | |
|---|---|---|---|---|
| 1,526,013 | A | 2/1925 | Roseberry | |
| 2,257,965 | A | 10/1941 | Koch | |
| 2,294,420 | A | 9/1942 | Place | |
| 2,967,559 | A | 1/1961 | Garrison | |
| 3,776,016 | A * | 12/1973 | Quinn et al. | 72/327 |
| 4,489,584 | A * | 12/1984 | Gall et al. | 72/327 |
| 6,128,987 | A * | 10/2000 | Nakagawa et al. | 83/76.9 |
| 2004/0020261 | A1 * | 2/2004 | Tokuda | 72/334 |
| 2006/0107721 | A1 * | 5/2006 | Oishi et al. | 72/327 |

FOREIGN PATENT DOCUMENTS

| | | |
|---|---|---|
| JP | 56134025 | 10/1981 |
| JP | 58224028 | 12/1983 |
| JP | 59169625 | 9/1984 |

* cited by examiner

*Primary Examiner* — Dana Ross
*Assistant Examiner* — Lawrence Averick
(74) *Attorney, Agent, or Firm* — Dickinson Wright PLLC

(57) ABSTRACT

A method of cutting scrap trimmed from a workpiece as well as the stamping die and scrap cutter assembly include a die having a cutting edge. An insert is coupled to the die and is moveable between first and second positions. The insert includes a cutting edge aligned with the die cutting edge when in the first position. A scrap cutter includes a cutting edge aligned with another edge of the insert. A biasing member maintains the insert at the first position during a trimming operation when the cutting edges of the insert and the die trim the scrap from the workpiece. The insert is driven toward the second position when the cutting edge of the scrap cutter cuts the scrap.

16 Claims, 5 Drawing Sheets

INTERCHANGEABLE SPRING LOADED SCRAP CUTTER

This application claims the benefits of U.S. Provisional Application No. 61/152,062, filed Feb. 12, 2009.

BACKGROUND

The present disclosure relates to a mechanism for trimming sheet metal stampings. More particularly, a trimming die and interchangeable spring loaded scrap cutter is disclosed.

In the manufacture of automobile body panels such as fenders, hoods and deck lids, it is relatively common practice to form large stampings by one or more sheet metal drawing operations. To perform the drawing operation, a steel sheet is positioned between moveable drawing dies. The pre-formed sheet is typically oversized to allow material to flow into the cavities of the dies during the drawing operation. In some instances, the excess material at the perimeter of the sheet is clamped during the drawing process.

After the drawing operation has been completed, a trimming operation is performed to remove excess material from the perimeter of the formed component. The trimming operation is typically performed by a set of trim dies separate from the forming dies. During the trimming operation it is sometimes challenging to accurately remove a small amount of material about the perimeter of the formed part in an accurate and expeditious manner. In particular, when large contoured panels such as hoods are formed, a correspondingly large and unwieldy ring is separated from the panel during the trimming operation. It is desirable to remove the formed panel and the scrap trim ring from the die as quickly and as completely as possible.

Scrap cutters have been mounted within trim dies to cut the trim ring into two or more pieces to facilitate removal of the scrap from the trim die. Challenges have arisen when attempting to package portions of the trim die operable to perform the trimming operation and the tooling necessary to cut the scrap within a common envelope. In one known arrangement, the trim dies and scrap cutter components are positioned such that a majority, but not all, of the formed panel is separated from the trim ring during a first portion of the press stroke. As the trim and forming dies continue to move toward one another, the remaining portion of the trim ring is separated from the workpiece by the scrap cutters at the same time that the trim ring is cut into multiple pieces. Unfortunately, this die arrangement and procedure produces undesirable slivers of material that sometimes remain in the trim and/or forming die after the workpiece and the larger scrap pieces are removed. When the subsequent panel to be trimmed enters the die set, the sliver of material interferes with the trimming die, the scrap cutter and/or the workpiece to the extent that the die set or the part to be formed is damaged. Undesirable down time and repair costs result. Accordingly, there is a need in the art for an improved trimming die and spring loaded scrap cutter.

SUMMARY

This section provides a general summary of the disclosure, and is not a comprehensive disclosure of its full scope or all of its features.

A stamping die and scrap cutter assembly for trimming scrap from a workpiece and cutting the scrap includes a die having a cutting edge. An insert is coupled to the die and is moveable between first and second positions. The insert includes a cutting edge aligned with the die cutting edge when in the first position. A scrap cutter includes a cutting edge aligned with another edge of the insert. A biasing member maintains the insert at the first position during a trimming operation when the cutting edges of the insert and the die trim the scrap from the workpiece. The insert is driven toward the second position when the cutting edge of the scrap cutter cuts the scrap.

Additionally, a method of cutting scrap trimmed from a workpiece in a die set includes positioning the workpiece between first and second dies. The first die is moved toward the second die. A moveable insert is coupled to one of the dies and is biased toward a home position. The method includes engaging the dies and the insert with the workpiece to separate a scrap portion from the workpiece. First and second scrap cutters are engaged with the scrap portion. The scrap portion is cut into separate pieces during the same die stroke used for separating the scrap portion from the workpiece. One of the first and second scrap cutters drives the insert away from the home position during scrap cutting.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
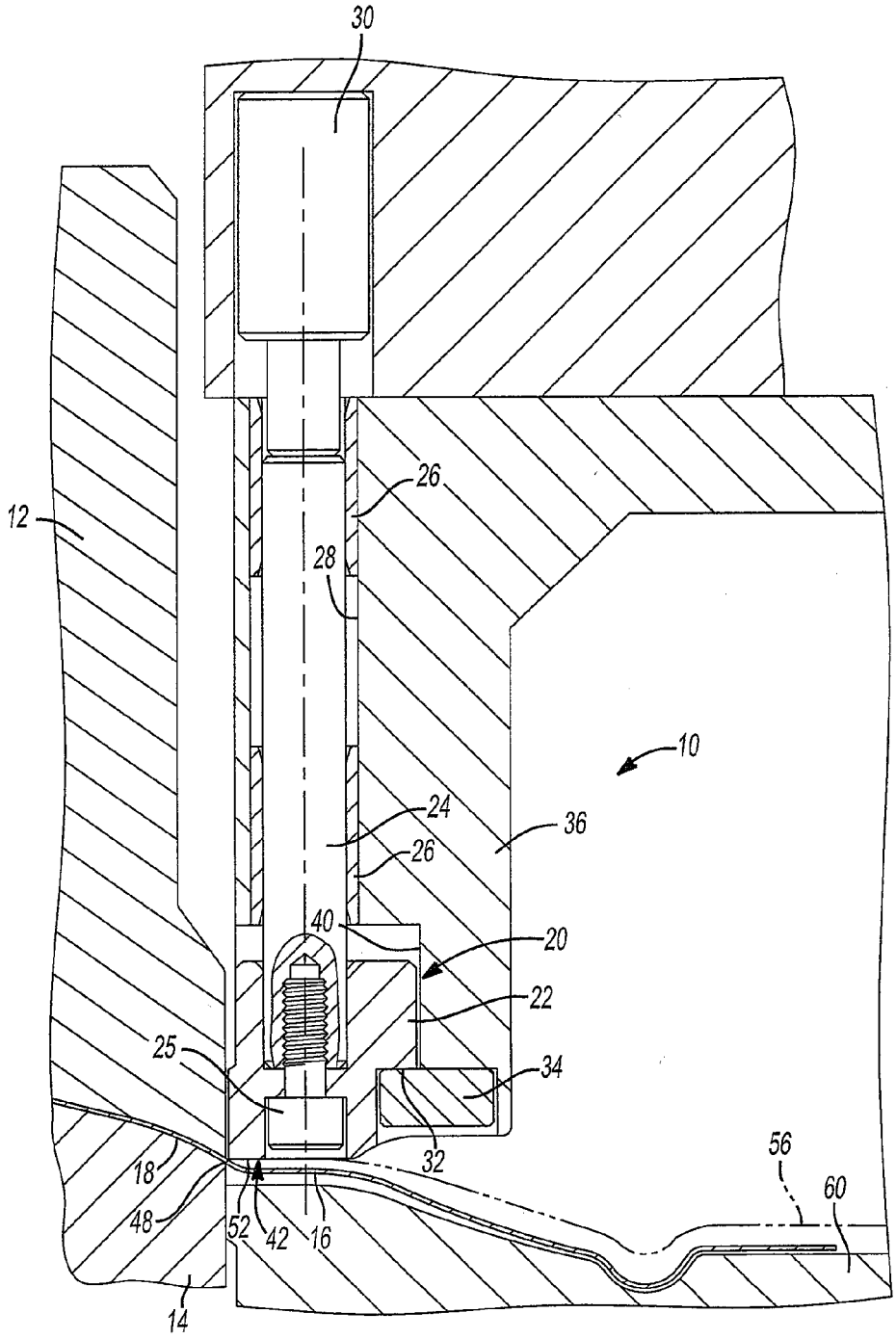
FIG. 1 is a fragmentary cross-sectional view of a die set includes an interchangeable spring loaded scrap cutter assembly according to the present disclosure.
Figure 2:
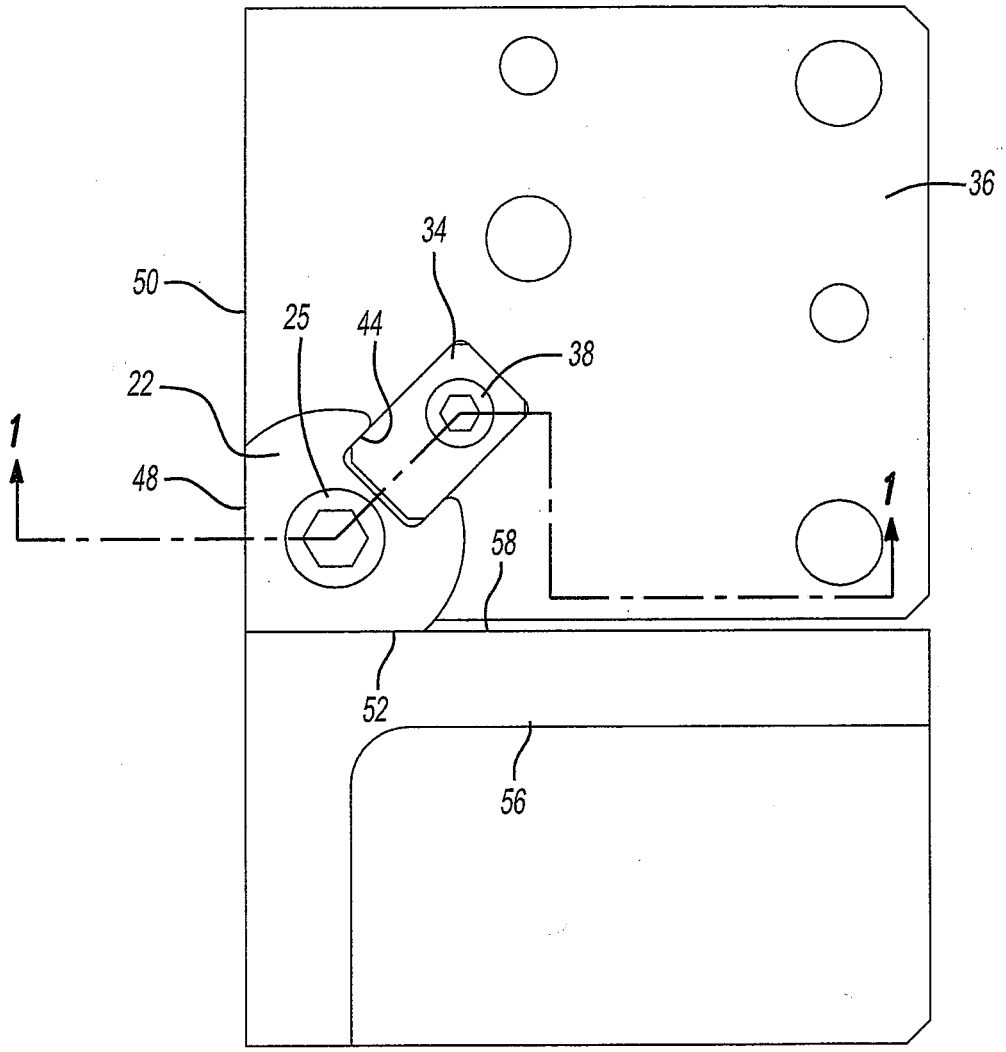
FIG. 2 is a plan view of a portion of the scrap cutter assembly.
Figure 3:
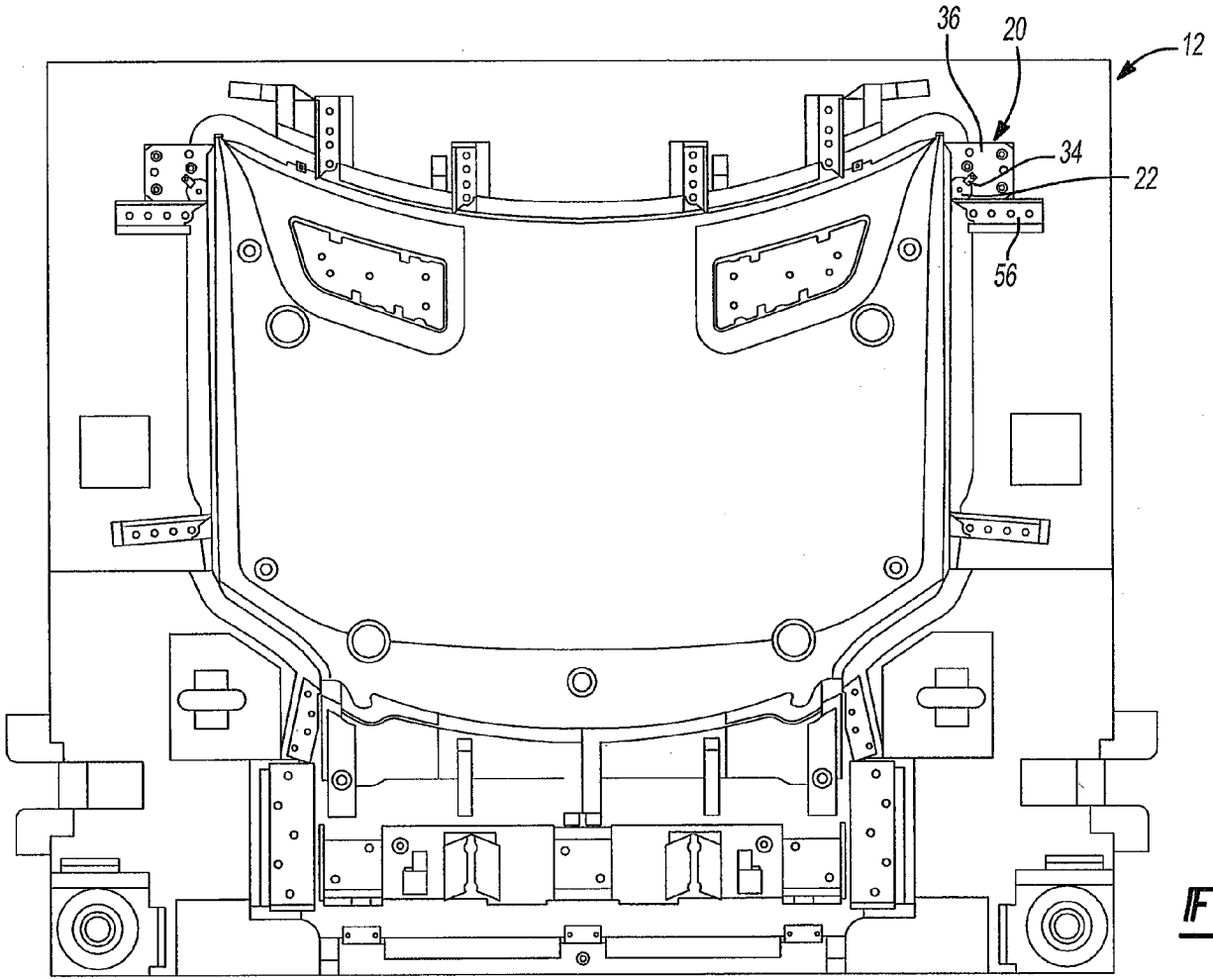
FIG. 3 is a plan view of an upper die including a scrap cutter assembly.
Figure 4:
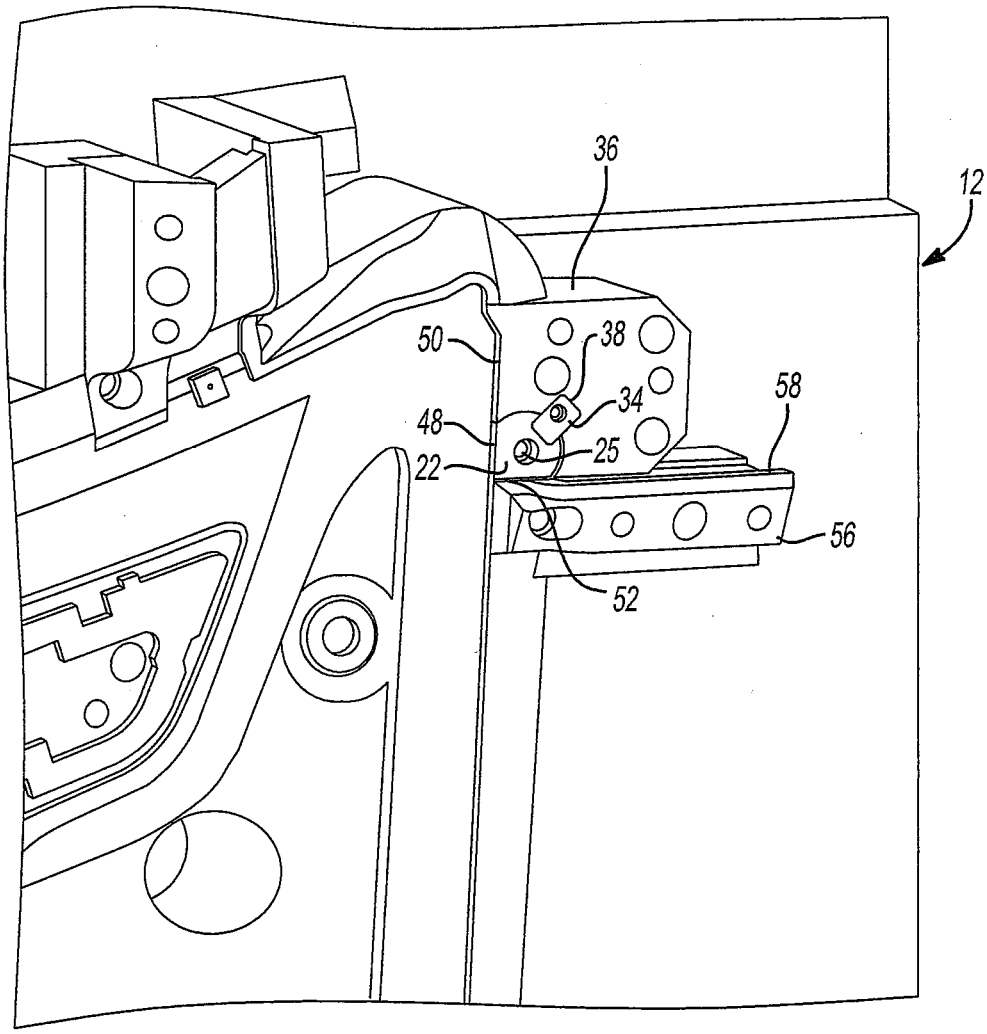
FIG. 4 is a fragmentary perspective view of the upper die and scrap cutter assembly.

Example embodiments will now be described more fully with reference to the accompanying drawings.

With reference to FIGS. 1-4, a die set 10 includes an upper die 12 moveable relative to a lower die 14. Die set 10 is operable to separate a scrap ring 16 from a workpiece 18. An interchangeable spring loaded scrap cutter assembly 20 is coupled to upper die 12.

Scrap cutter assembly 20 includes a moveable insert 22 fixed to an axially translatable shaft 24 by a socket head cap screw 25. Shaft 24 is guided by a pair of bushings 26 pressed into a bore 28 formed in upper die 12. A gas shock 30 is pressurized to bias a stop face 32 of insert 22 against a retainer 34. Retainer 34 is fixed to a mounting block 36 by another cap screw 38. Block 36 is mounted to upper die 12. FIG. 1 shows insert 22 at a lower position with stop face 32 engaging retainer 34. Insert 22 is positioned within a pocket 40 formed within upper die 12. When sufficient force to overcome gas shock 30 is applied to a cutting end 42 of insert 22, insert 22 moves away from the lower position depicted in FIG. 1 to a position where stop face 32 is no longer engaged with retainer 34. Retainer 34 slides within a slot 44 formed in insert 22 during relative movement between mounting block 36 and insert 22. Retainer 34 is sized to closely match the width of slot 44 to restrict rotation of insert 22.

Insert 22 includes a cutting edge 48 that is aligned with a cutting edge 50 formed on mounting block 36 when insert 22 is at the lower position. Insert 22 includes another edge 52 extending substantially perpendicularly from cutting edge 48. An upper scrap cutter 56 is fixed to upper die 12. Upper scrap cutter 56 includes a cutting edge 58 aligned with edge 52 of insert 22. Upper scrap cutter 56 is positioned parallel to cooperate with a lower scrap cutter 60 such that when upper die 12 moves toward lower die 14, cutting edge 58 of upper scrap cutter 56 passes closely by a cooperating cutting edge 62 of lower scrap cutter 60 to cut scrap ring 16.

A number of additional upper scrap cutters are positioned about the perimeter of upper die 12. Associated lower scrap cutters (not shown) are mounted to lower die 14 at positions to define shearing interfaces between corresponding upper scrap cutters. One or more of the additional scrap cutters may be equipped with a spring loaded insert similar to insert 22. In particular, it is contemplated that it may be beneficial to include additional spring loaded inserts in order to further reduce the likelihood of slivers of scrap being formed during scrap cutting.

Figures 5, 6, 7, 8:
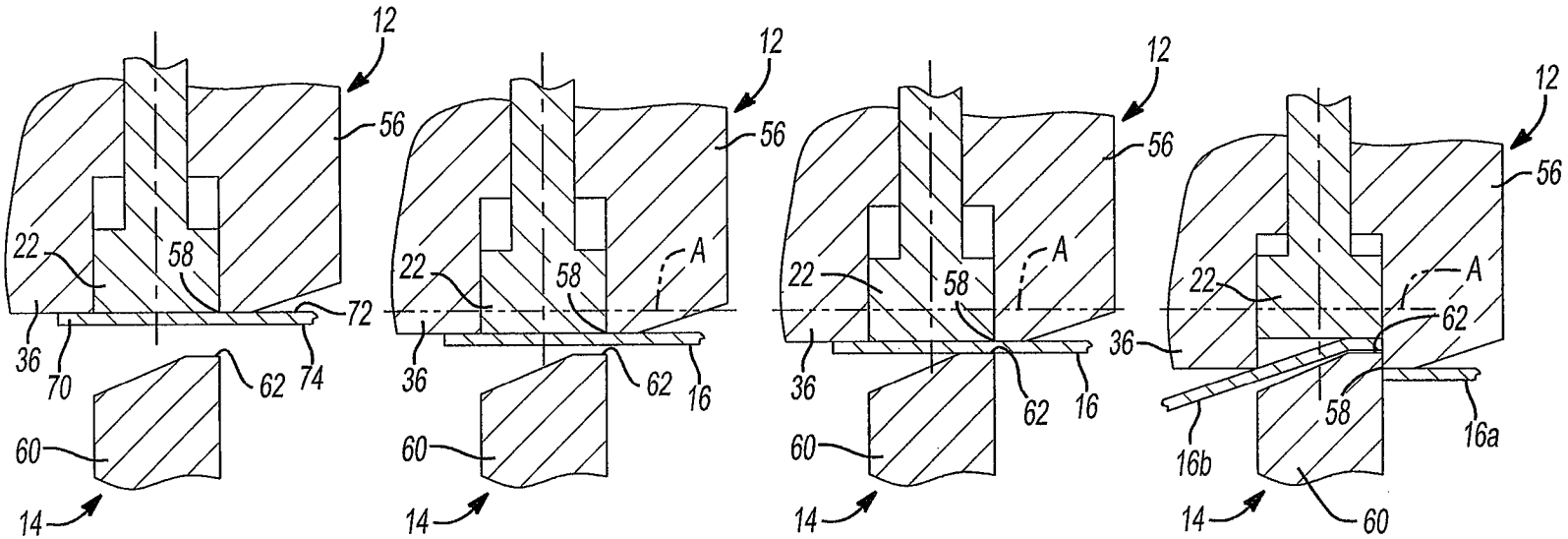
FIGS. 5-8 are simplified fragmentary cross-sectional views depicting first through fourth stages of operation of the die set.

FIGS. 5-8 provide a schematic representation depicting first through fourth stages of operation of die set 10. FIG. 1 depicts stage 1 where a contiguous sheet of metal 70 is positioned between upper die 12 and lower die 14 with upper die 12 in a position contacting an upper surface 72 of sheet 70 immediately prior to separating sheet 70 into workpiece 18 and scrap ring 16. Upper surface 72 is aligned with a reference plane A at this time. In FIG. 5, the portion of lower die 14 that cuts workpiece 18 from scrap ring 16 is not shown. It should be appreciated that a lower surface 74 of sheet 70 is resting on a portion of lower die 14 at this time. Lower scrap cutter 60 is clear of sheet 70.

Between stages 1 and 2, upper die 12 moves toward lower die 14 to separate workpiece 18 from scrap ring 16. The force provided by gas shock 30 is sufficient to overcome the force required for this portion of the trimming operation. Therefore, insert 22 remains abutted against retainer 34 such that cutting edge 48 remains aligned with cutting edge 50.

FIG. 6 depicts stage 2 where upper die 12 continues to drive scrap ring 16 toward lower scrap cutter 60. At this time, insert 22 remains in its lower position. As shown in FIG. 7, stage 3 includes upper die 12 continuing to travel toward lower scrap cutter 60 placing lower surface 74 in contact with lower scrap cutter 60 while upper surface 72 remains in contact with upper scrap cutter 56, insert 22 and other portions of upper die 12.

FIG. 8 depicts stage 4 and the location of a number of components just after scrap ring 16 has been cut into smaller scrap portions identified as 16*a* and 16*b*. During the scrap cutting operation, upper die 12 is moved toward lower die 14 to a location where at least a portion of lower scrap cutter 60 drives insert 22 upwardly into pocket 40. At this time, scrap ring 16 is separated into smaller scrap pieces including at least pieces 16*a* and 16*b*. Once the scrap cutting of scrap ring 16 has been completed, upper die 12 is moved away from lower die 14 to allow removal of the trim ring pieces and workpiece 18. The process may be repeated as desired.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A stamping die and scrap cutter assembly for trimming scrap from a workpiece and cutting the scrap, comprising:
   - a die having a die cutting edge and being moveable in a first direction;
   - an insert coupled to and at least partially disposed within the die and being moveable with the die in the first direction;
   - a biasing member urging the insert in the first direction;
   - a scrap cutter being stationary and having a scrap cutter cutting edge; and
   - wherein during a trimming operation, movement of the die in the first direction to cut the workpiece causes the insert to be driven by the scrap cutter in a second direction opposite of the first direction relative to the die.

2. The stamping die and scrap cutter assembly of claim 1 further including another scrap cutter mounted to another die, the another scrap cutter including another scrap cutter cutting edge cooperating with the scrap cutter cutting edge of the scrap cutter to cut the scrap.

3. The stamping die and scrap cutter assembly of claim 2 wherein the another die includes a cutting edge, one of the die and the another die being moveable toward the other such that the cutting edges of the die and the another die pass one another as the scrap cutter approaches the another scrap cutter.

4. The stamping die and scrap cutter assembly of claim 1 further including a mounting block fixed to the die and a retainer fixed to the mounting block to restrict movement of the insert.

5. The stamping die and scrap cutter assembly of claim 4 wherein the insert is biased towards the retainer.

6. The stamping die and scrap cutter assembly of claim 4 wherein the insert includes a cylindrical surface engaging the mounting block.

7. The stamping die and scrap cutter assembly of claim 1 wherein the cutting edge of the insert intersects the another edge of the insert.

8. The stamping die and scrap cutter assembly of claim 1 wherein the biasing member includes a gas shock.

9. A method of cutting scrap trimmed from a workpiece in a die set, the method comprising:
   - positioning the workpiece between a moveable first die and a stationary scrap cutter;
   - biasing a moveable insert coupled to and at least partially disposed within the first die in a first direction toward a home position;
   - moving the first die in the first direction towards the scrap cutter to cut the workpiece; and
   - driving the insert in a second direction opposite of the first direction and away from the home position as the first die is moving in the first direction.

10. The method of claim 9 further including mounting a retainer to the first die and engaging the insert with the retainer at the home position.

11. The method of claim 10 further including fixing a mounting block to the die and slidably positioning the insert within a bore formed in the mounting block, the retainer being fixed to the mounting block.

12. The method of claim 11 wherein a portion of the mounting block includes a cutting edge aligned with a cutting edge formed on the insert.

13. The method of claim 12 further including separating the scrap portion from the workpiece with the cutting edges.

14. The method of claim 9 wherein the insert moves linearly.

15. The method of claim 9 wherein the biasing includes applying a load from a gas shock to the insert.

16. The method of claim 9 further including forming a scrap portion as an uninterrupted ring surrounding the workpiece.

* * * * *